United States Patent [19]

Theurer et al.

[11] 4,267,777

[45] May 19, 1981

[54] MOBILE BALLAST CLEANING MACHINE

[75] Inventors: Josef Theurer, Vienna; Karl Fölser, Linz-Urfahr, both of Austria

[73] Assignee: Franz Plasser Bahnbaumaschinen-Industriegesellschaft m.b.H., Vienna, Austria

[21] Appl. No.: 47,010

[22] Filed: Jun. 11, 1979

[30] Foreign Application Priority Data

Jun. 16, 1978 [AT] Austria ..... 4418/78

[51] Int. Cl.[3] ..... E01B 27/10

[52] U.S. Cl. ..... 104/7 R; 37/104; 171/16; 404/101

[58] Field of Search ..... 104/1, 2, 7 R; 37/104–107, 142.5, DIG. 1; 171/16; 222/613, 622; 414/294, 296; 404/84, 91, 101, 108; 405/179; 246/182 B

[56] References Cited

U.S. PATENT DOCUMENTS

| | | | |
|---|---|---|---|
| 3,685,589 | 8/1972 | Plasser et al. | 171/16 |
| 3,725,921 | 4/1973 | Weidman et al. | 246/182 B UX |
| 3,976,142 | 8/1976 | Plasser et al. | 171/16 |
| 4,108,076 | 8/1978 | Knape | 104/2 |

FOREIGN PATENT DOCUMENTS

| | | | |
|---|---|---|---|
| 2394844 | 2/1979 | France | 171/16 |
| 1453457 | 10/1976 | United Kingdom | 171/16 |

*Primary Examiner*—Randolph A. Reese
*Attorney, Agent, or Firm*—Kurt Kelman

[57] ABSTRACT

A mobile ballast cleaning machine comprises a ballast redistribution monitoring and control arrangement for controlling the amount of redistributed ballast, which includes an adjustment circuit responsive to output signals produced by monitoring devices for the speed of the forward drive of the machine, the speed of the ballast excavating and conveying chain drive, and the amount of cleaned ballast conveyed by the ballast redistributing conveyor.

17 Claims, 4 Drawing Figures

MOBILE BALLAST CLEANING MACHINE

The present invention relates to improvements in a mobile ballast cleaning machine.

U.S. Pat. Nos. 3,685,589, dated Aug. 22, 1972, and 3,976,142, dated Aug. 24, 1976, disclose a commercially successful machine of this type which comprises a frame mounted for mobility on a track supported on ballast, a drive for moving the frame along the track in an operating direction, means mounted on the frame for excavating ballast from a track section and for conveying the excavated ballast, a drive for moving the ballast excavating and conveying means, a ballast cleaning means arranged on the frame to receive the ballast from the excavating and conveying means, to clean the ballast and to discharge the cleaned ballast into a conveying path, and means mounted on the frame in the conveying path for conveying the cleaned ballast discharged from the ballast cleaning means and for redistributing the cleaned ballast to the excavated track section. To compensate for difference in the delivered amounts of cleaned ballast, the machine is equipped with a ballast storing means of relatively small volume for storing clean ballast, the ballast storage means being arranged between the ballast cleaning means and the track section and receiving the cleaned ballast for selectively storing the same and permitting selected portions of the clean and cleaned ballast to be deposited underneath the track section. More particularly, the ballast storage means is mounted under a ballast redistributing conveyor system at a discharge end thereof at the track section, thus at least partially covering this track section from visual observation by an operator. Also, this location of the ballast storage means makes it very difficult to place other desirable ballasting equipment there because of lack of space. In addition, the positioning of the rather heavy ballast storage means with its stored ballast midway on the machine frame between the front and rear axles subjects the frame to considerable stresses. On the other hand, the storage means has made it possible to compensate for varying ballast flows although it was not always possible for the operator to monitor and control the amount of redistributed ballast. It is particularly difficult to determine how much to reduce or increase the amount of cleaned ballast when the forward speed of the machine is decreased due to varying ballast bed conditions or the depth of the ballast bed is to be changed to obtain a desired track grade. Frequently, the operator can determine only after the cleaned ballast has been redistributed whether there is too much or too little ballast in the track section.

British Pat. No. 1,453,457, published Oct. 20, 1976, discloses a machine of the above type wherein the ballast storage means is arranged on the frame in the conveying path for selectively receiving the cleaned ballast from the ballast cleaning means and discharging the stored ballast to the conveying and redistributing means. This machine also comprises a ballast flow monitoring and control arrangement. The forward speed of the machine is responsive to this arrangement. In response to the monitored loads on the drive motors for the ballast excavating chain and the ballast redistributing conveyors or the monitored conveying capacity thereof, a speed control governor for the forward drive of the machine changes the forward speed so that the monitored values are held within predetermined limits, the forward speed being reduced or increased in response to these limits being exceeded or not reached. The purpose of the control is to maintain the load on the excavating chain and the cleaning screen at its optimum value and not to overload the drive motors for the excavating chain and redistributing conveyors. This control arrangement has the major disadvantage that the changing forward speed of the machine changes the amount of redistributed ballast so that, over an extended section of track, the depth of the ballast bed constantly changes, thus making an accurate track grade impossible. Furthermore, there is no possibility of temporarily storing cleaned ballast coming from the ballast cleaning screen when such storage becomes desirable due to a temporary reduction in the forward speed of the machine, for example, thus avoiding an undue accumulation of redistributed ballast in certain track sections. Altogether, the unevenness of the level of the ballast bed obtained with this machine makes it frequently necessary to use additional equipment before a new track can be laid thereon, which makes it impractical, for instance, to use this machine in a track renewal train.

It is the primary object of this invention to eliminate the disadvantages of the last-mentioned type of mobile ballast cleaning machine and to improve the first-mentioned type of machine so that the cleaned ballast may be redistributed more evenly over long stretches of track even where the ballast bed conditions vary greatly, thus providing a cleaned ballast bed providing an accurate level for a track to be laid on it.

In the indicated type of mobile ballast cleaning machine, the invention accomplishes this and other objects by providing drive monitoring devices respectively producing an output signal responsive to the speeds of the drive for moving the frame and for moving the ballast excavating and conveying means, a measuring means arranged to measure the amount of conveyed cleaned ballast before it is redistributed to the excavated track section, a measuring means monitoring device producing an output signal responsive to the measured amount of conveyed ballast, and a ballast redistribution monitoring and control arrangement for controlling the amount of redistributed ballast, the monitoring and control arrangement including an adjustment circuit means responsive to the output signals produced by the monitoring devices whereby the amount of redistributed cleaned ballast is controlled by the drive speed of the machine, the drive speed of the ballast excavating and conveying means, and the amount of conveyed cleaned ballast. The ballast storage means comprises a ballast storage receptacle arranged on the frame in the conveying path for selectively receiving the cleaned ballast from the ballast cleaning means and discharging the stored ballast to the conveying and redistributing means.

The continuous monitoring and automatic control of the amount of redistributed cleaned ballast in combination with the indicated arrangement of the ballast storage receptacle for the first time advantageously and simply enables the establishment of an even cleaned ballast bed of a desired level over a long stretch of track. This continuous monitoring and control of the amount of cleaned ballast redistributed to the excavated track section and the compensation made possible by the interposed ballast storage hold this ballast amount accurately within the desired limits to establish the desired ballast level for support of a renewed track. This even ballast bed can be obtained despite changes in the forward speed of the machine and differences in the amounts of cleaned ballast coming from the cleaning means since the redistribution of the cleaned ballast is monitored immediately before it is deposited in the track section and the flow of cleaned ballast thereof is continuously controlled in response to the monitored value selectively from the cleaning means and/or the storage receptacle. Thus, it is possible to avoid ballast accumulations when the forward movement of the machine is unexpectedly interrupted whereby errors in the grade level are avoided, the same holding true for the track point where the machine begins forward movement again or where it stops.

The above and other objects, advantages and features of the present invention will become more apparent from the following detailed description of a preferred embodiment thereof, taken in conjunction with the accompanying schematic drawing wherein FIG. 1 is a side elevational view of a mobile ballast cleaning machine incorporating the ballast storage receptacle and redistribution monitoring and control arrangements of this invention;

Figures 1, 2, 3, 4:
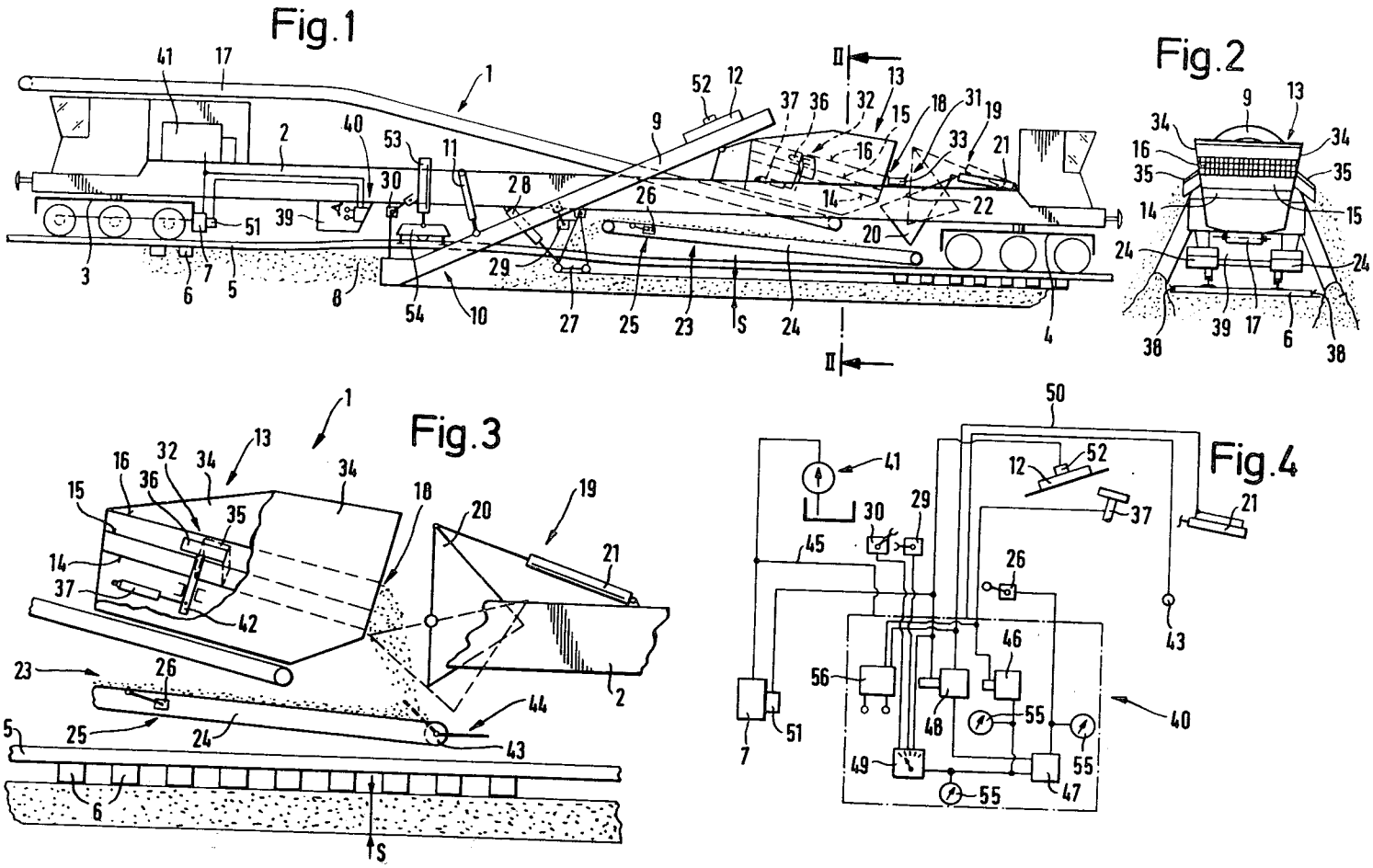
FIG. 2 is an end view of the machine according to line II—II of FIG. 1.
FIG. 3 is an enlarged side elevational view showing the cooperation of the ballast cleaning means, with a side wall partly broken away, the ballast storage receptacle and a ballast redistributing conveyor.
FIG. 4 is a circuit diagram schematically illustrating the ballast redistribution monitoring and control arrangement of the invention.

Referring now to the drawing, there is shown mobile ballast cleaning machine 1 comprising frame 2 mounted for mobility on a track consisting of rails 5 fastened to ties 6 supported on ballast 8. Machine frame 2 is supported on undercarriages 3 and 4, each undercarriage having three axles and drive 7 being connected to the axles of undercarriage 3 for moving the frame along the track in an operating direction so that the machine can be self-propelled. On the other hand, couplings are provided at the respective ends of frame 2 to enable the machine to be incorporated into a train for forward movement therewith, if desired.

Means 9 is mounted on the frame for excavating ballast 8 from track section 10 and for conveying the excavated ballast, this ballast excavating means being generally conventional and comprising an endless excavating chain with a transverse stringer running below the track, drive 12 being arranged for moving the ballast excavating and conveying means so that the excavated ballast is transported to ballast cleaning means 13 arranged on frame 2 to receive the ballast from excavating and conveying means 9, to clean the ballast and to discharge the cleaned ballast into a conveying path, this ballast cleaning means comprising a generally conventional ballast screening arrangement. Ballast excavating and conveying means 9 may be vertically adjusted by hydraulic motors 11 linking this means to machine frame 2 and suspending it thereon. The ballast screening arrangement 13 comprises a series of three superposed vibratory screens 14, 15, 16 of differing mesh sizes to separate re-usable, cleaned ballast portions from fines of waste which is deposited on conveyor 17 and removed. As best shown in FIG. 3, the housing for screening arrangement 13 has outlets 18 associated with the vibratory screens for discharging the cleaned ballast into a conveying path by gravity.

Ballast storage means 19 comprising storage receptacle 20 is arranged on frame 2 in the conveying path for selectively receiving the cleaned ballast (see broken-line position in FIG. 3) and discharging the stored ballast (see full-line position in FIG. 3) to means 23 mounted on frame 2 in the conveying path for conveying the cleaned ballast discharged from ballast cleaning means 13 and for redistributing the cleaned ballast to the excavated track section 10. Ballast storage receptacle 20 is mounted on frame 2 by horizontal pivot 22 extending transversely to the track and is pivotal about this pivot by drive 21. Ballast conveying and redistributing means 23 is shown to include longitudinally extending, elongate conveyor 24 having an input end below outlets 18 and receptacle 20 and an output end opposite thereto and adjacent track section 10 for discharging the cleaned ballast at this section. Drive 43 moves the conveyor band to transport the cleaned ballast from the input to the output end.

In the preferred embodiment of the present invention, the ballast conveying and redistributing means comprises an endless conveyor 24 associated with each track rails 5 and a respective one of storage receptacles 20 is associated with each endless conveyor.

Ballast planing and compacting means 27 for planing and compacting the redistributed cleaned ballast in excavated track section 10 is also mounted on frame 2, drive 28 linking ballast planing and compacting means 27 to the frame for vertical adjustment of this means. Frame 2 also carries track lifting means 53 for raising the track in track section 10, all as generally conventional.

In accordance with this invention and as will be explained more fully hereinafter, the amount of redistributed ballast is controlled by a ballast redistributing monitoring and control arrangement which includes adjustment circuit means 40 responsive to output signals from (1) drive monitoring device 51 producing an output signal responsive to the speed of drive 7, (2) another drive monitoring device 52 producing an output signal responsive to the speed of drive 12 for moving ballast excavating and conveying means 9, and (3) measuring means monitoring device 26 producing an output signal responsive to the amount of conveyed ballast determined by measuring means 25 arranged to measure the amount of conveyed ballast on endless conveyor 24 before it is redistributed to excavated track section 10. In this manner, the amount of redistributed cleaned ballast is controlled by, or is a function of, the drive speed of machine 1, the drive speed of ballast excavating and conveying means 9, and the amount of conveyed ballast.

Ballast measuring means 25 may be a weighing device or it may be a device for measuring the thickness of the ballast layer on the conveyor, for example, any suitable means for measuring the amount of ballast near the discharge or output end of conveyor 24 being effective.

In the illustrated embodiment of ballast cleaning machine 1, monitoring device 29 is arranged to monitor continuously the vertical distance of ballast planing and compacting means 27 from frame 2, i.e. the level of the redistributed cleaned ballast, and monitoring device 30 similarly monitors the vertical position of the excavating stringer of ballast excavating and conveying chain 9, i.e. the depth of the ballast excavation. Preferably, means are connected to all or at least some of the monitoring devices for visibly or otherwise indicating the output signals.

Where means are connected to the monitoring devices for indicating the output signals, the operator is enabled to initiate actuation of the drives essentially controlling the ballast flow manually on reading the indicated parameters so that the desired amount of cleaned ballast will be redistributed. The indicating means also facilitate constant monitoring of the operational results obtained by the fully automatic controls.

In accordance with a preferred feature of the invention, ballast flow control means 31, 32 is incorporated in ballast cleaning means 13 for adjusting the ballast flow therethrough. Ballast flow control means 31 comprises transversely extending ballast conveyor 33 arranged on machine frame 2 to receive the cleaned ballast from outlet 18 associated with the uppermost screen 16 of ballast cleaning means 13. This conveyor is a guide means designed to redistribute some of the cleaned ballast to a selected shoulder of the track. Ballast flow control means 32 comprises adjustable baffles 36 associated with outlets 35 in side walls 34 of the housing of the ballast cleaning means associated with screen 15, the outlets being guide means directing the cleaned ballast from screen 15 to a selected shoulder of the track and the adjustable baffles controlling the flow of cleaned ballast therethrough. Drive 37 for actuating the flow control means is connected to baffles 36 for adjusting the baffles.

As shown in FIG. 2, outlets 35 are arranged to direct the cleaned ballast towards ballast region 38 laterally adjacent the track next to the tie ends. Baffle 36 associated with each outlet 35 in a respective side wall 34 is mounted on vertical pivoting axle 42 so that the baffle may be pivoted by drive 37 into selected angular positions in relation to the associated outlet transversely to the track to enable selected amounts of cleaned ballast to be delivered through the outlet from screen 15. The cleaned ballast from lowermost screen 14 and any cleaned ballast from screen 15, which does not pass through lateral outlets 35, is discharged through end outlets 18 into the conveying path, either directly to endless redistributing conveyor 24 or to interposed receptacle 20 (depending on the latter's pivotal position). It is possible to dispense with ballast flow control conveyor 33, in which case the cleaned ballast from screen 16 also passes through outlets 18.

Ballast flow control means 31, 32 makes it possible selectively to reduce the amount of cleaned ballast to be either stored or redistributed by conveyor 24. Thus, any amount of cleaned ballast exceeding that required for the desired depth of the ballast bed and for filling the cribs between the ties can be stored in the track shoulders. Where a transverse ballast conveyor 33 is used in conjunction with chutes moving the cleaned ballast from screen 16 to the conveyor, it is possible to dispose of considerable excess amounts of ballast. If the chutes are rather long and cover selected portions of screen 16, it is even possible to dispose of uncleaned amounts of ballast without burdening the screening arrangement unnecessarily with cleaning work.

In the illustrated embodiment, all the drives are hydraulic motors, drives 11, 21, 37 and 53 being cylinder-and-piston devices. Central operator's cab 39 is mounted on the underside of machine frame 2 within sight of track section 10 and houses the control panel which is the terminal for adjustment circuit 47 of the ballast redistribution monitoring and control arrangement 40 of this invention. This circuit is responsive to the output signals produced by monitoring devices 51, 52 and 26 whereby the amount of redistributed cleaned ballast is controlled by the speed of drive 7, the speed of drive 12 and the amount of the conveyed cleaned ballast on conveyor 24. The adjustment circuit is connected to central power source 41 mounted on the machine frame and operating the hydraulic pumps associated with the various drives.

As best shown in FIG. 3, storage receptacle 20 is pivotally mounted for pivoting between a loading position wherein the receptacle receives and stores cleaned ballast from ballast cleaning means 13, a discharging position wherein the receptacle discharges the stored ballast to endless conveyor 24 and a rest position wherein the cleaned ballast is discharged directly from the cleaning means to the conveyor, drive 21 pivoting the storage receptacle between these positions. In this manner, the storage receptacle itself may be used partially as a means for controlling the ballast flow since its pivotal position will determine the amount of cleaned ballast flowing through the conveying path for redistribution to the excavated track section.

Depending on local track conditions, a heavily encrusted and/or deep ballast bed may cause the forward movement of machine 1 as well as the speed of ballast excavating and conveying chain 9 to be reduced or even halted. In this case, ballast storage receptacle 20 may be pivoted from its rest position shown in full lines into a loading position shown in broken lines to be interposed in the conveying path between outlets 18 and redistributing conveyor 24 so that the entire cleaned ballast will be stored in the receptacle and none will reach the ballast redistributing conveyor. As soon as the forward movement of the machine and the excavating work of chain 9 are resumed, storage receptacle 20 can be pivoted into a discharging position, the angle of the receptacle and the corresponding amount of cleaned ballast discharged therefrom being readily controllable to direct a desired amount of cleaned ballast to conveyor 24. As will be explained hereinafter in connection with a more detailed description of arrangement 40, the amount of ballast discharged from receptacle 20, i.e. its pivotal position, can be controlled in response to the amount of ballast conveyed on conveyor 24 and measured at 25 so that a ballast layer of a constant depth s may be laid down and planed by planing and compacting means 27.

The capacity of receptacle 20 should be such that sufficient amounts of ballast are available for producing a ballast bed of a desired depth s in the time interval required for the excavated ballast to move from track section 10 to outlets 18 of the ballast cleaning means.

FIG. 4 schematically illustrates ballast redistribution monitoring and control arrangement 40 for fully automatically controlling the amount of redistributed ballast to assure the production of an uninterrupted ballast bed of substantially constant depth s over an extended stretch of track, regardless of the forward speed of the machine, the excavating capacity of chain 9 or other track conditions, and without intervention by the operator. Control arrangement 40 is connected to energy input line 45 which symbolically illustrates the hydraulic and electrical lines connecting the control arrangement to central electrical and hydraulic power source 41 which includes suitable supply lines, generators, pumps and the like required for the operation of the control arrangement and its drives. The control arrangement includes adjustment circuit means 47 and, connected thereto, first control element 46, second control element 48 and adjustment circuit setting element 49, the control elements being responsive to adjustment circuit 47 and the setting element adjusting the circuit. Indicating instruments 55 are connected to the adjustment circuit and the monitoring devices for visibly indicating the respective output signals thereof.

First control element 46 is connected to ballast flow control means drive 37 for operating the drive. Second control element 48 is connected to ballast storage receptacle pivoting drive 21. Adjustment circuit setting element 49 receives the output signals from monitoring device 52 of drive 12, monitoring device 29 of ballast planing and compacting means 27 and monitoring device 30 which monitors the level of the transverse excavating stringer of chain 9, and its output is connected to the input of adjustment circuit 47. The adjustment circuit also receives the output signal from monitoring device 26 which gages the amount of cleaned ballast conveyed on ballast redistributing conveyor 24 and measured by means 25. In this manner, adjustment circuit 47 is set by the output signals from setting element 49 as a function of the drive speed of ballast excavating and conveying means 9 as well as the levels of the excavated and redistributed ballast and from monitoring device 26 as a function of the amount of the conveyed cleaned ballast. The setting element is initially manually adjusted by the operator according to the desired depth s of the ballast layer to be produced in the excavated track section, the output signals of element 49 being transmitted to adjustment circuit 47 to redistribute a corresponding amount of cleaned ballast. After its initial setting, element 49 is continuously and automatically controlled by the output signals received from monitoring devices 29, 30 and 52, thus responding to changing track conditions while maintaining the desired flow of cleaned ballast by correspondingly setting adjustment circuit 47.

The input signals from monitoring device 26 indicating the actual amount of conveyed cleaned ballast and from setting element 49 indicating the desired amount of cleaned ballast to be conveyed are compared in adjustment circuit 47 and the comparison signal is transmitted from the adjustment circuit to control element 48 to pivot ballast storage receptacle 20 into a desired position in the conveying path of the cleaned ballast, as hereinabove described. As shown, control line 50 connects the output of adjustment circuit 47 with pivoting drive 21 for receptacle 20 and control element 48, which is a circuit breaker, is mounted in the control line. The output signals from monitoring devices 51 and 52 of drives 7 and 12 are connected to and control element 48. Monitoring devices 51 and 52 will provide an output signal only if drives 7 and 12 are stopped, i.e. the machine is halted and the excavating chain stops moving. When such output signals from monitoring devices 51 and 52 actuate circuit breaker control element 48, pivoting drive 21 will be operated to pivot ballast storage receptacle 20 into the loading position so that the entire amount of cleaned ballast is received exclusively by storage means 19 and none of the excavated ballast is redistributed.

The monitoring and control of the redistributed amount of ballast is further facilitated by transmitting the output signals from monitoring devices 51 and 52 as well as monitoring device 30 of lifting and lining device 54 to setting element 49. The setting element may be arranged to set ajustment circuit 47 so that the flow of cleaned ballast to ballast redistributing means 23 is adjusted as a function of the change in the speeds of drives 7 and 12.

If a ballast redistributing conveyor 24 with its own storage receptacle 20 is associated with each rail 5, as preferred, monitoring and control arrangement 40 has an adjustment circuit 47, with control elements 46 and 48 and setting element 49 connected to each means 25 for measuring the amount of conveyed cleaned ballast. In this case, the adjustment drives 37 for each ballast control flow means 32 mounted to cooperate with lateral outlets 35 in side walls 34 are also separately controlled, these drives also being connected to the adjustment circuit. In this manner, the ballast redistribution may be separately and independently controlled for the ballast regions associated with the respective track rails, thus making it possible, for example to redistribute increased amounts of ballast to the superelevated rail in a track curve.

As has been explained hereinabove, storage receptacle 20 is pivotally mounted for pivoting between a loading position wherein the receptacle receives and stores cleaned ballast from ballast cleaning means 13, a discharging position wherein the receptacle discharges the stored ballast in adjustable amounts depending on the pivoting angle of the receptacle, and a rest position wherein the cleaned ballast is discharged directly from the cleaning to the conveying and redistributing means, drive 21 pivoting the storage receptacle between these positions. In the preferred monitoring and control arrangement herein illustrated and above described, second control element 48 is connected to pivoting drive 21 for operating the drive, which element is responsive to adjustment circuit 47 and which additionally responds to limit signals from monitoring devices 51 and 52 to pivot the receptacle into the loading position when drives 7 and 12 stop. On the other hand, at the beginning of the forward movement of machine 1 and operation of excavating chain 9, i.e. when drives 7 and 12 start, a limit signal from monitoring device 26 signalling a desired amount of cleaned ballast to be redistributed causes adjustment circuit 47 to set the second control element 48 for operating the pivoting drive to pivot the storage receptacle into a discharging position until the desired amount of cleaned ballast has been supplied to redistributing conveyor 24. This arrangement automatically and without any intervention by the operator assures the proper flow of cleaned ballast during an interruption of the machine and/or excavating chain drives as well as at the beginning of re-starting of the operation, avoiding either accumulation of ballast on conveyor 24 or a lack of sufficient ballast for redistribution. Since the ballast in the ballast cleaning means at the time of a stoppage is stored in receptacle 20, sufficient cleaned ballast from the receptacle is available at the resumption of operation for redistribution until such time as fresh excavated ballast is cleaned and moved into the conveying path again. The exact positioning of the storage receptacle and the corresponding amount of redistributed cleaned ballast is further controlled by constantly monitoring the amount of cleaned ballast on conveyor 24 and using the output signal from monitoring device 26 for setting adjustment circuit 47. In this manner, the depth of the cleaned ballast bed is accurately and automatically controlled without intervention by the operator. Since the output signals from monitoring device 26 are proportional to the amount of cleaned ballast measured by weight measuring means or ballast layer thickness gage 25, the desired amount of cleaned ballast supplied to conveyor 24 by suitable pivoting of receptacle 20 will be constantly maintained.

Provision of setting element 49 enables suitable adjustment of adjustment circuit 47 to produce the desired ballast flow and, in the preferred embodiment of this invention, the setting element is arranged to receive and respond to the output signals from monitoring devices 29 and 30 proportional to the levels of the excavated track section and the cleaned, restored ballast bed. This produces an additional ballast flow control finely attuned to the desired ballast bed depth and profile, avoiding any subsequent removal of excess ballast from the finished track bed, which is time-consuming and expensive. This control also assures that an even and smooth ballast bed will be produced where the original bed is uneven and varying excavating depths prevail along the stretch of track being rehabilitated.

The operation of machine 1 will partly be obvious from the above description of its structure and will be explained in further detail hereinafter.

When the machine arrives at the operating site and after suitably positioning ballast excavating and conveying chain 9, motor 12 is actuated to drive the chain and to excavate ballast from track section 10, the moving chain conveying the excavated ballast to ballast cleaning means 13. There, waste is separated from the usable ballast remaining on screens 14, 15 and 16, the waste is removed on conveyor 17 and the re-usable cleaned ballast is conveyed by gravity from end outlets 18 to adjustable baffle 44 which, depending on its position, guides adjustable portions of the cleaned ballast to redistributing conveyor 24 and into successive cribs, as machine 1 advances, or the baffle may be pivoted out of the conveying path entirely to supply all the cleaned ballast to conveyor 24. The portion of the cleaned ballast supplied to conveyor 24 is redistributed by the conveyor to track section 10, motor 43 being actuated to move the conveyor. The redistributed cleaned ballast is smoothed and compacted by ballast planing and compacting means 27 under the control of monitoring device 29, machine frame 2 serving as the reference, to produce a desired depth s of the cleaned ballast bed. This is done, as has been explained hereinabove, by transmitting the outut signals of ballast bed monitoring devices 29 and 30 to setting element 49 of control arrangement 40. On comparing the desired level with the actual level, hydraulic drive 28 may be actuated to correspondingly raise or lower ballast planing and compacting means 27 to produce the desired ballast bed level. By suitably adjusting the pivotal position of baffle 44, any excess amount of cleaned ballast not required for obtaining the desired ballast bed level may be used to fill the cribs, amounts of ballast beyond this requirement being stored in receptacle 20. Furthermore, particularly where it is desired to produce a ballast bed with machine 1 which is ready to enable a succeeding track renewal train to lay a track on this bed, excess cleaned ballast may also be deposited at shoulders 38 laterally adjacent the track bed so that a smooth and even ballast bed remains therebetween. For this purpose, ballast flow control means 32 is controlled by control element 46 which, in turn, is responsive to the output from adjustment circuit 47 set by setting element 49 and monitoring device 26. Thus, the ballast flow to regions 38 laterally adjacent the track will be a function of the actual amount of cleaned ballast on redistributing conveyor 24. The ballast flow may be controlled in the same manner if ballast guide baffles 36 are used to direct cleaned ballast to chutes placed on screens 14, 15, 16 to deliver cleaned ballast to transverse conveyor 33.

The ballast flow may be so controlled that excess cleaned ballast is directed to shoulders 38 by ballast flow control means 31 and/or 32 when the forward speed of the machine remains constant but the amount of excavated ballast varies while any excess ballast due to a reduction in the speed of drives 7 and/or 12 is stored by suitably pivoting receptacle 20. In this manner, the excess cleaned ballast is stored ready for use when the drives resume their original speed, thus always having sufficient cleaned ballast available to maintain a desired ballast bed depth s.

If some obstacle in the ballast bed causes excavating chain 9 to stop, a limit output signal will be transmitted from monitoring device 52 to circuit breaker element 48. This will cause pivoting drive 21 to pivot storage receptacle 20 into the loading position so that all the cleaned ballast coming from outlets 18 is stored in the receptacle. Upon resumption of the excavating chain operation, cleaned ballast is required immediately for redistribution to assure that the ballast bed depth remain constant. Accordingly, since no limit signals are received by control element 48 from monitoring devices 51 and 52 associated with machine drive 7 and excavating chain drive 12, the control element will operate pivoting drive 21 in response to the output signal from adjustment circuit 47 which, in turn, responds to the setting of element 49 and the output signal from monitoring device 26. In this manner, the pivoting position of the ballast storage receptacle responds to the amount of cleaned ballast on redistributing conveyor 24 to discharge a required amount of stored ballast from the receptacle to the conveyor in direct proportion to the output signal of adjustment circuit 47.

The redistributing conveyor is supplied with stored ballast until the ballast excavated after resumption of the operation has been cleaned and reached outlets 18. This will produce an additional flow of cleaned ballast and an increasing amount of cleaned ballast will be measured at 25. The corresponding output signal from monitoring device 26 will cause adjustment circuit 47 to adjust the pivoting position of receptacle 20 correspondingly, control element 48 connecting pivoting drive 21 to circuit 47 to pivot the receptacle so that is supplies less or no stored ballast to redistributing conveyor 24, depending on the amount of ballast registered at 25. Further flow of cleaned ballast from ballast cleaning means 13 to the redistributing conveyor is then controlled by means 31 and/or 32 in the above-indicated manner.

The circuitry of ballast redistribution monitoring and control arrangement 40 is preferably such that receptacle 20 is pivoted into an adjusted discharging position any time that insufficient cleaned ballast is supplied to conveyor 24 from outlets 18, as measured at 25.

Also, in the preferred embodiment, indicating instruments 55 will visibly indicate to the operator the amount of ballast registered at 25 as well as the difference between the actual and desired amount of redistributed cleaned ballast determined in adjustment circuit 47.

If the ballast bed depth s is monitored by devices 29 and 30 at each side of the track, i.e. in the region of each rail, the required amounts of cleaned ballast may be accordingly controlled at each track side to provide desired superelevations. It is also possible to determine the desired amount of redistributed ballast by manually setting element 49 depending on the track position before and after ballast cleaning so that the required ballast amount may be determined as a function of the track position. This has the considerable advantage that a simple and light-weight planing and compacting means 27 will assure a good track bed and a constant bed depth even where the original ballast bed is poor and its depth varies greatly.

As shown in FIG. 4, monitoring and control arrangement 40 also includes a manually operable control member 56 connected to drives 21 and 37 to enable the operator to control the pivoting position of receptacle 20 and the flow control means 32 in response to parameters read on indicating instruments 55. This provides a manual control in addition to the fully automatic control of the amount of redistributed cleaned ballast. In the manual control, the operator does no longer rely simply on his experience and viewing of the ballast bed, as heretofore, but exact parameters are indicated to him on instruments 55 so that he can set the controls accurately according to the indicated parameters.

While a pivotal ballast storage receptacle has been described and illustrated as part of the ballast flow control, it is also possible to use a stationary storage receptacle. In this case, control element 48 is connected to and operates drive means for adjustable gates in outlet chutes of the storage receptacle to control the flow of stored ballast to redistributing conveyor 24 or for conveying means arranged to convey stored cleaned ballast out of the storage receptacle to the redistributing conveyor. If a stationary storage receptacle is used, it is preferred to use ballast guide means between outlets 18 and ballast storage means 19 and/or ballast redistributing means 23, such guide means to be adjustably positioned for assuring a selected flow of cleaned ballast to one and/or the other means 19, 23, depending on the determined difference between the actual and desired amount of cleaned ballast on conveyor 24. When the advance of the machine and/or the excavating chain is stopped, this guide means is positioned to direct all the cleaned ballast from outlets 18 to storage means 19.

What is claimed is:

1. A mobile ballast cleaning machine comprising (a) a frame mounted for mobility on a track supported on ballast, (b) a drive for moving the frame along the track in an operating direction, (c) a drive monitoring device producing an output signal responsive to the drive speed, (d) means mounted on the frame for excavating ballast from a track section and for conveying the excavated ballast, (e) a drive for moving the ballast excavating and conveying means, (f) another drive monitoring device producing an output signal responsive to the speed of the drive for moving the ballast excavating and conveying means, (g) a ballast cleaning means arranged on the frame to receive the ballast from the excavating and conveying means, to clean the ballast and to discharge the cleaned ballast into a conveying path, (h) means mounted on the frame in the conveying path for conveying the cleaned ballast discharged from the ballast cleaning means and for redistributing the cleaned ballast to the excavated track section, (i) a measuring means arranged to measure the amount of conveyed cleaned ballast before it is redistributed to the excavated track section, (j) a measuring means monitoring device producing an output signal responsive to the measured amount of conveyed ballast, (k) a ballast storage receptacle arranged on the frame in the conveying path for selectively receiving the cleaned ballast from the ballast cleaning means and discharging the stored ballast to the conveying and redistributing means, (l) a ballast redistribution monitoring and control arrangement for controlling the amount of redistributed ballast, the monitoring and control arrangement including (1) an adjustment circuit means responsive to the output signals produced by the monitoring devices whereby the amount of redistributed cleaned ballast is controlled by the drive speed of the machine, the drive speed of the ballast excavating and conveying means, and the amount of the conveyed cleaned ballast, (m) a ballast flow control means in the ballast cleaning means for adjusting the ballast flow therethrough, and (n) a drive for actuating the flow control means, the monitoring and control arrangement including a first control element responsive to the adjustment circuit means and connected to the ballast flow control means drive for operating the drive.

2. The mobile ballast cleaning machine of claim 1, further comprising means for lifting the track at the excavated track section and means for planing and compacting the redistributed cleaned ballast.

3. The mobile ballast cleaning machine of claim 1, wherein the monitoring and control arrangement further comprises means connected to the monitoring devices for indicting the output signals.

4. The mobile ballast cleaning machine of claim 1, wherein the ballast flow control means comprises guide means for selectively directing cleaned ballast towards a region of the ballast laterally adjacent the track.

5. The mobile ballast cleaning machine of claim 4, wherein the ballast cleaning means comprises a housing having lateral walls and a series of superposed screens mounted in the casing, and the guide means comprises ballast outlet means in the side walls of the housing associated with a respective one of the screens, the outlet means directing the cleaned ballast towards the ballast region laterally adjacent the track, and adjustable baffle means associated with the outlet means for controlling ballast flow therethrough, the drive for actuating the flow control means being connected to the baffle means and adjusting the baffle means.

6. The mobile ballast cleaning machine of claim 4 or 5, wherein the guide means includes a transversely extending ballast conveyor arranged on the frame to receive the cleaned ballast from the ballast cleaning means and to direct the cleaned ballast towards the ballast region laterally adjacent the track.

7. The mobile ballast cleaning machine of claim 1, wherein the means for conveying and redistributing the cleaned ballast comprises an endless conveyor and a drive for moving the conveyor, the conveyor drive being connected to the monitoring and control arrangement for operating the drive.

8. The mobile ballast cleaning machine of claim 1, wherein the means for conveying and redistributing the cleaned ballast comprises an endless conveyor having a ballast discharge end adjacent the excavated track section, the measuring means is mounted on the conveyor near the discharge end, and the monitoring and control arrangement includes means adjusting the flow of cleaned ballast to the conveyor in response to the output signal from the measuring means monitoring device.

9. The mobile ballast cleaning machine of claim 1, further comprising a setting element connected to the adjustment circuit means and the adjustment circuit means being responsive to an output signal from the setting element corresponding to an amount of cleaned ballast required to be redistributed to obtain a desired ballast bed configuration.

10. The mobile ballast cleaning machine of claim 1, wherein the means for conveying and redistributing the cleaned ballast comprises an endless conveyor associated with each track rail, one of the measuring means being associated with each endless conveyor, a ballast storage recepticle being associated with each endless conveyor, and the adjustment circuit means being responsive to the output signals produced by the monitoring devices associated with the respective conveyors.

11. A mobile ballast cleaning machine comprising (a) a frame mounted for mobility on a track supported on ballast, (b) a drive for moving the frame along the track in an operating direction, (c) a drive monitoring device producing an output signal responsive to the drive speed, (d) means mounted on the frame for excavating ballast from a track section and for conveying the excavated ballast, (e) a drive for moving the ballast excavating and conveying means, (f) another drive monitoring device producing an output signal responsive to the speed of the drive for movng the ballast excavating and conveying means, (g) a ballast cleaning means arranged on the frame to receive the ballast from the excavating and conveying means, to clean the ballast and to discharge the cleaned ballast into a conveying path, (h) means mounted on the frame in the conveying path for conveying the cleaned ballast discharged from the ballast cleaning means and for redistributing the cleaned ballast to the excavated track section, (i) a measuring means arranged to measure the amount of conveyed cleaned ballast before it is redistributed to the excavated track section, (j) a measuring means monitoring device producing an output signal responsive to the measured amount of conveyed ballast, (k) a ballast storage receptacle arranged on the frame in the conveying path for selectively receiving the cleaned ballast from the ballast cleaning means and discharging the stored ballast to the conveying and redistributing means, the storage receptacle being pivotally mounted for pivoting between a loading position wherein the receptacle receives and stores cleaned ballast from the ballast cleaning means, a discharging position wherein the receptacle discharges the stored ballast to the conveying and redistributing means, and a rest position wherein the cleaned ballast is discharged directly from the cleaning to the conveying and redistributing means, (l) a drive for pivoting the storage receptacle between said positions, and (m) a ballast redistribution monitoring and control arrangement for controlling the amount of redistributed ballast, the monitoring and control arrangement including (2) an adjustment circuit means responsive to the output signals produced by the monitoring devices whereby the amount of redistributed cleaned ballast is controlled by the drive speed of the machine, the drive speed of the ballast excavating and conveying means, and the amount of the conveyed cleaned ballast, and (2) a control element responsive to the adjustment circuit means and connected to the pivoting drive for operating pivoting drive.

12. The mobile ballast cleaning machine of claim 11, wherein the output signals responsive to the respective drive speeds include limit signals respectively signalling stoppage of the movement of the frame and of the ballast excavating and conveying means, and the adjustment circuit means is arranged to respond to the limit signals to set the control element for operating the pivoting drive to pivot the storage receptacle into the discharging position.

13. The mobile ballast cleaning machine of claim 12, wherein the output signal responsive to the measured amount of conveyed ballast includes a limit signal signalling a desired amount of cleaned ballast to be redistributed, and the adjustment circuit means is arranged to respond to said limit signal to set the control element for operating the pivoting drive to pivot the storage receptacle between the discharging and loading positions.

14. A mobile ballast cleaning machine comprising (a) a frame mounted for mobility on a track supported on ballast, (b) a drive for moving the frame along the track in an operating direction, (c) a drive monitoring device producing an output signal responsive to the drive speed, (d) means mounted on the frame for excavating ballast from a track section and for conveying the excavated ballast, (e) a drive for moving the ballast excavating and conveying means, (f) another drive monitoring device producing an output signal responsive to the speed of the drive for moving the ballast excavating and conveying means, (g) a ballast cleaning means arranged on the frame to receive the ballast from the excavating and conveying means, to clean the ballast and to discharge the cleaned ballast into a conveying path, (h) means mounted on the frame in the conveying path for conveying the cleaned ballast discharged from the ballast cleaning means and for redistributing the cleaned ballast to the excavated track section, the means for conveying and redistributing the cleaned ballast comprising an endless conveyor having a ballast discharge end adjacent the excavated track section, (i) a measuring means mounted on the conveyor near the discharge end and arranged to measure the amount of conveyed ballast before it is redistributed to the excavated track section, (j) a measuring means monitoring device producing an output signal responsive to the measured amount of conveyed ballast, (k) a ballast storage receptacle arranged on the frame in the conveying path for selectively receiving the cleaned ballast from the ballast cleaning means and discharging the stored ballast to the conveying and redistributing means, the storage receptacle being pivotally mounted for pivoting between a loading position wherein the receptacle receives and stores cleaned ballast from the ballast cleaning means, a discharging position wherein the receptacle discharges the stored ballast to the endless conveyor and a rest position wherein the cleaned ballast is discharged directly from the cleaning means to the conveyor, (l) a drive for pivoting the storage receptacle between said positions, and (m) a ballast redistribution monitoring and control arrangement for controlling the amount of redistributed ballast, the monitoring and control arrangement including (1) an adjustment circuit means responsive to the output signals produced by the monitoring devices whereby the amount of redistributed cleaned ballast is controlled by the drive speed of the machine, the drive speed of the ballast excavating and conveying means, and the amount of the conveyed cleaned ballast, and (2) means adjusting the flow of cleaned ballast to the conveyor in response to the output signal from the measuring means monitoring device, the flow adjusting means including a control element responsive to the adjustment circuit means in response to the output signal from the measuring means monitoring device for operating the drive.

15. The mobile ballast cleaning machine of claim 14, further comprising ballast flow control means in the ballast cleaning means for adjusting the ballast flow therethrough and a drive for actuating the flow control means, the means for adjusting the flow of cleaned ballast to the conveyor including a first control element responsive to the adjustment circuit means and connected to the ballast flow control means drive for operating the drive.

16. A mobile ballast cleaning machine comprising (a) a frame mounted for mobility on a track supported on ballast, (b) a drive for moving the frame along the track in an operating direction, (c) a drive monitoring device producing an output signal responsive to the drive speed, (d) means mounted on the frame for excavating ballast from a track section and for conveying the excavated ballast, (e) a drive for moving the ballast excavating and conveying means, (f) another drive monitoring device producing an output signal responsive to the speed of the drive for moving the ballast excavating and conveying means, (g) a ballast cleaning means arranged on the frame to receive the ballast from the excavating and conveying means, to clean the ballast and to discharge the cleaned ballast into a conveying path, (h) means mounted on the frame in the conveying path for conveying the cleaned ballast discharged from the ballast cleaning means and for redistributing the cleaned ballast to the excavated track section, (i) a measuring means arranged to measure the amount of conveyed cleaned ballast before it is redistributed to the excavated track section, (j) a measuring means monitoring device producing an output signal responsive to the measured amount of conveyed ballast, (k) a ballast storage receptacle arranged on the frame in the conveying path for selectively receiving the cleaned ballast from the ballast cleaning means and discharging the stored ballast to the conveying and redistributing means, (l) a ballast redistribution monitoring and control arrangement for controlling the amount of redistributed ballast, the monitoring and control arrangement including (1) an adjustment circuit means responsive to the output signals produced by the monitoring devices whereby the amount of redistributed cleaned ballast is controlled by the drive speed of the machine, the drive speed of the ballast excavating and conveying means, and the amount of the conveyed cleaned ballast, and (2) a setting element connected to the adjustment circuit means, the adjustment circuit means being responsive to an output signal from the setting element corresponding to an amount of cleaned ballast required to be redistributed to obtain a desired ballast bed configuration, and (m) a means for planing and compacting the redistributed cleaned ballast in the excavated track section, and (n) an additional monitoring device associated with the ballast planing and compacting means and producing an output signal responsive to the ballast level thereat, the setting element being arranged to receive and respond to the output signal from the additional monitoring device.

17. The mobile ballast cleaning machine of claim 16, wherein the setting element is arranged to receive and respond to at least one of the output signals from the drive speed monitoring devices.

* * * * *